US006905746B2

(12) United States Patent
Sellars

(10) Patent No.: US 6,905,746 B2
(45) Date of Patent: Jun. 14, 2005

(54) PACKAGING POUCH AND METHOD OF MAKING SAME

(75) Inventor: Neil G. Sellars, Cinnaminson, NJ (US)

(73) Assignee: National Label Company, Lafayette Hill, PA (US)

( * ) Notice: Subject to any disclaimer, the term of this patent is extended or adjusted under 35 U.S.C. 154(b) by 0 days.

(21) Appl. No.: 10/151,472

(22) Filed: May 17, 2002

(65) Prior Publication Data

US 2003/0027700 A1 Feb. 6, 2003

Related U.S. Application Data

(60) Provisional application No. 60/292,086, filed on May 17, 2001.

(51) Int. Cl.[7] ..... B32B 3/26

(52) U.S. Cl. ..... 428/40.1; 283/81; 428/41.4; 428/41.7; 428/41.9; 428/42.1; 428/42.2; 428/42.3; 428/43; 428/201; 428/202

(58) Field of Search ..... 428/40.1, 41.4, 428/41.7, 41.9, 42.1, 42.2, 42.3, 43, 201, 202; 283/81

(56) References Cited

U.S. PATENT DOCUMENTS 4,655,209 A * 4/1987 Scott ..... 128/156
5,284,363 A * 2/1994 Gartner ..... 283/81
5,727,819 A * 3/1998 Grosskopf et al. ..... 283/81

* cited by examiner

*Primary Examiner*—Nasser Ahmad
(74) *Attorney, Agent, or Firm*—Reed Smith LLP

(57) ABSTRACT

A substantially planar packaging device including printed indicia and defining a closed cavity being suitable for containing at least one product. The substantially planar packaging device including a first sheet forming the closed cavity, and a second sheet at least partially detachably coupled to the first sheet to allow the second sheet to be at least partially detached from the first sheet to view at least a portion of the indicia and reattached to the first sheet.

4 Claims, 5 Drawing Sheets

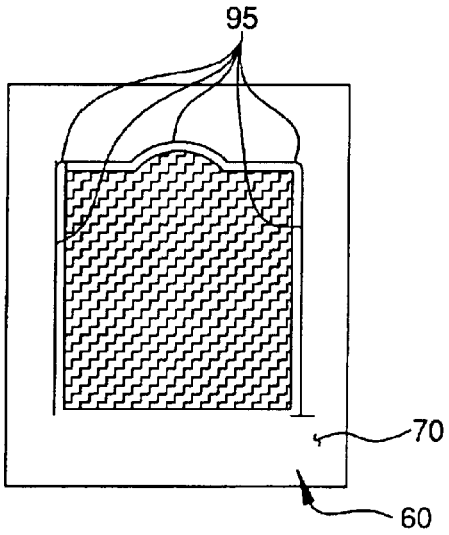
FIG. 1C
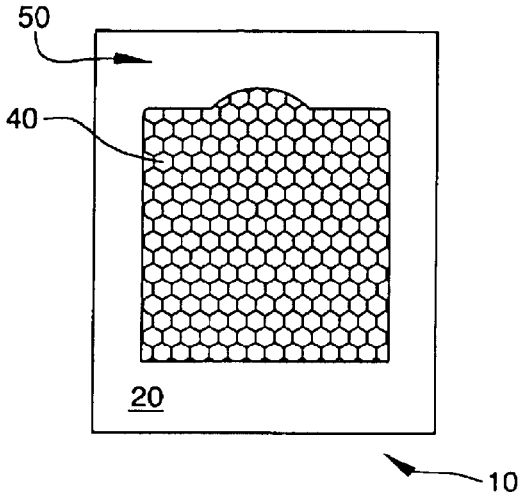
FIG. 1A
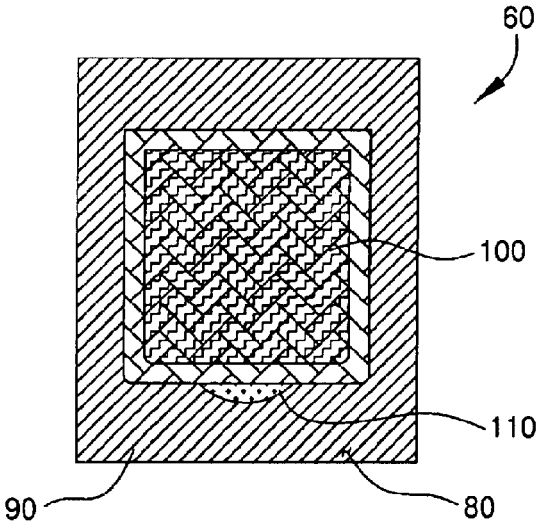
FIG. 1B
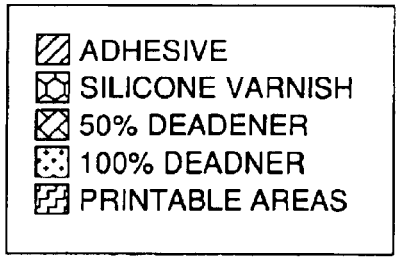

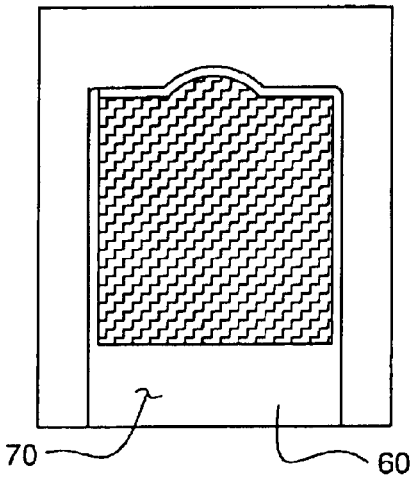
FIG. 3C
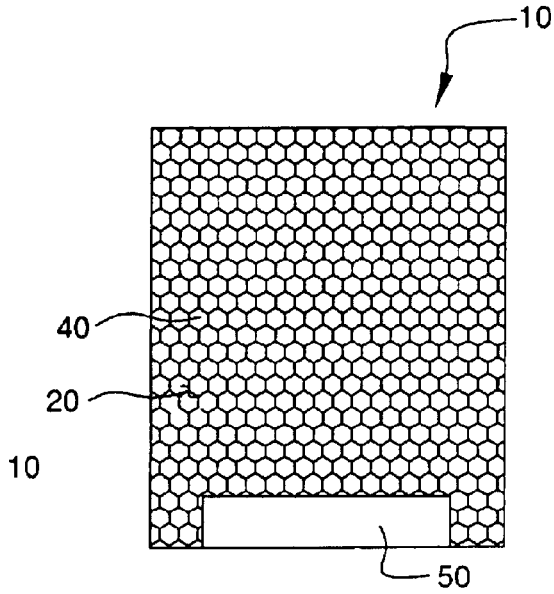
FIG. 3A
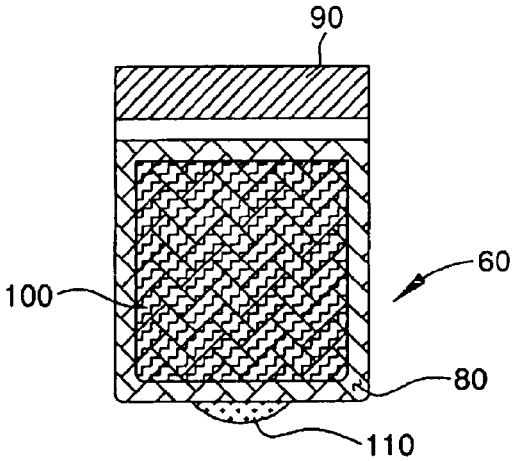
FIG. 3B
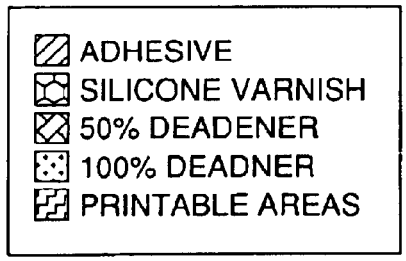

ADHESIVE
SILICONE VARNISH
50% DEADENER
100% DEADNER
PRINTABLE AREAS

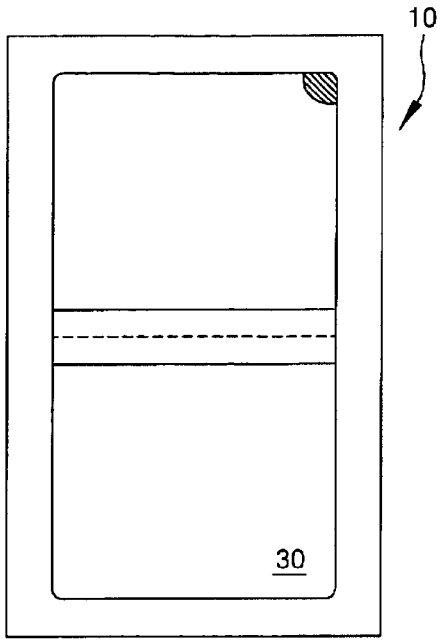
FIG. 5B
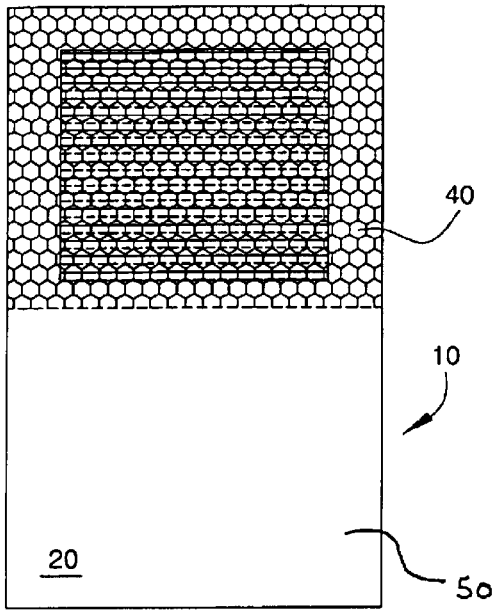
FIG. 5A
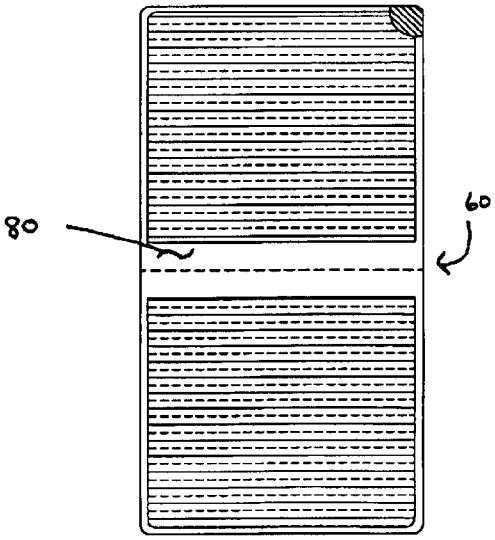
FIG. 5D
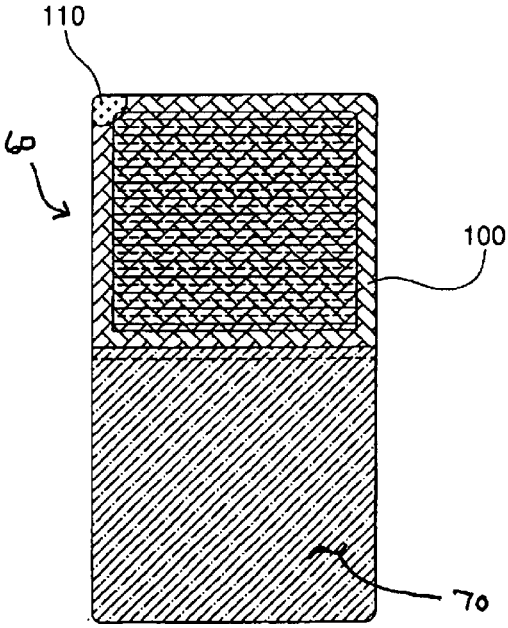
FIG. 5C
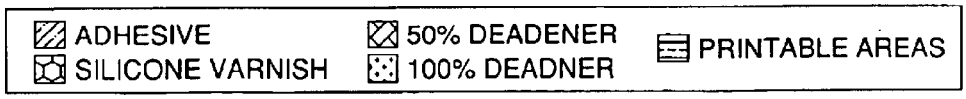

PACKAGING POUCH AND METHOD OF MAKING SAME

RELATED APPLICATION

This application claims priority of U.S. patent application Ser. No. 60/292,086, filed May 17, 2001, entitled IMPROVED PACKAGING POUCH, the entire disclosure of which is hereby incorporated by reference as if being set forth in its entirety herein.

FIELD OF INVENTION

The present invention relates to packaging in general, and packaging pouches in particular.

BACKGROUND OF THE INVENTION

It is desirable to increase available surface area of packaging for products that is suitable for being printed upon, e.g. billboard area. Such increased surface area can be used for many purposes, including provided information about a product packaged within the packaging.

However, it may not be desirable to increase the size of packaging. Accordingly, it is desirable to provide packaging that features increased billboard area without increasing the size of the packaging in overall dimensions.

SUMMARY OF INVENTION

A substantially planar packaging device including printed indicia and defining a closed cavity being suitable for containing at least one product, the device including a first sheet forming the closed cavity, and a second sheet at least partially detachably coupled to the first sheet to allow the second sheet to be at least partially detached from the first sheet to view at least a portion of the indicia and reattached to the first sheet.

BRIEF DESCRIPTION OF THE FIGURES

The invention will be better understood with reference to the following illustrative and non-limiting drawings, in which like references there-throughout designate like elements of the invention, and wherein:

FIG. 1A illustrates a plan-view of a surface of a base label according to a first form of the present invention;

FIG. 1B illustrates a plan-view of a surface of a top label suitable for use with the base label of FIG. 1A;

FIG. 1C illustrates a plan-view of a panel for use as part of a packaging pouch using the base and top labels of FIGS. 1A and 1B;

FIG. 3A illustrates a plan-view of a surface of a base label according to a second form of the invention;

FIG. 3B illustrates a plan-view of a surface of a top label suitable for use with the base label of FIG. 3A;

FIG. 3C illustrates a plan-view of a panel for a packaging pouch including the labels of FIGS. 3A and 3B;

FIG. 5A illustrates a plan view of a surface of a base label for a packaging pouch according to a fourth form of the present invention;

FIG. 5B illustrates a plan view of another surface of the base label of FIG. 5A;

FIG. 5C illustrates a plan view of a surface of a top label suitable for use with the base label of FIGS. 5A and 5B; and, FIG. 5D illustrates another surface of the top label of FIG. 5C.

DETAILED DESCRIPTION OF THE PREFERRED EMBODIMENTS

Figure 2:
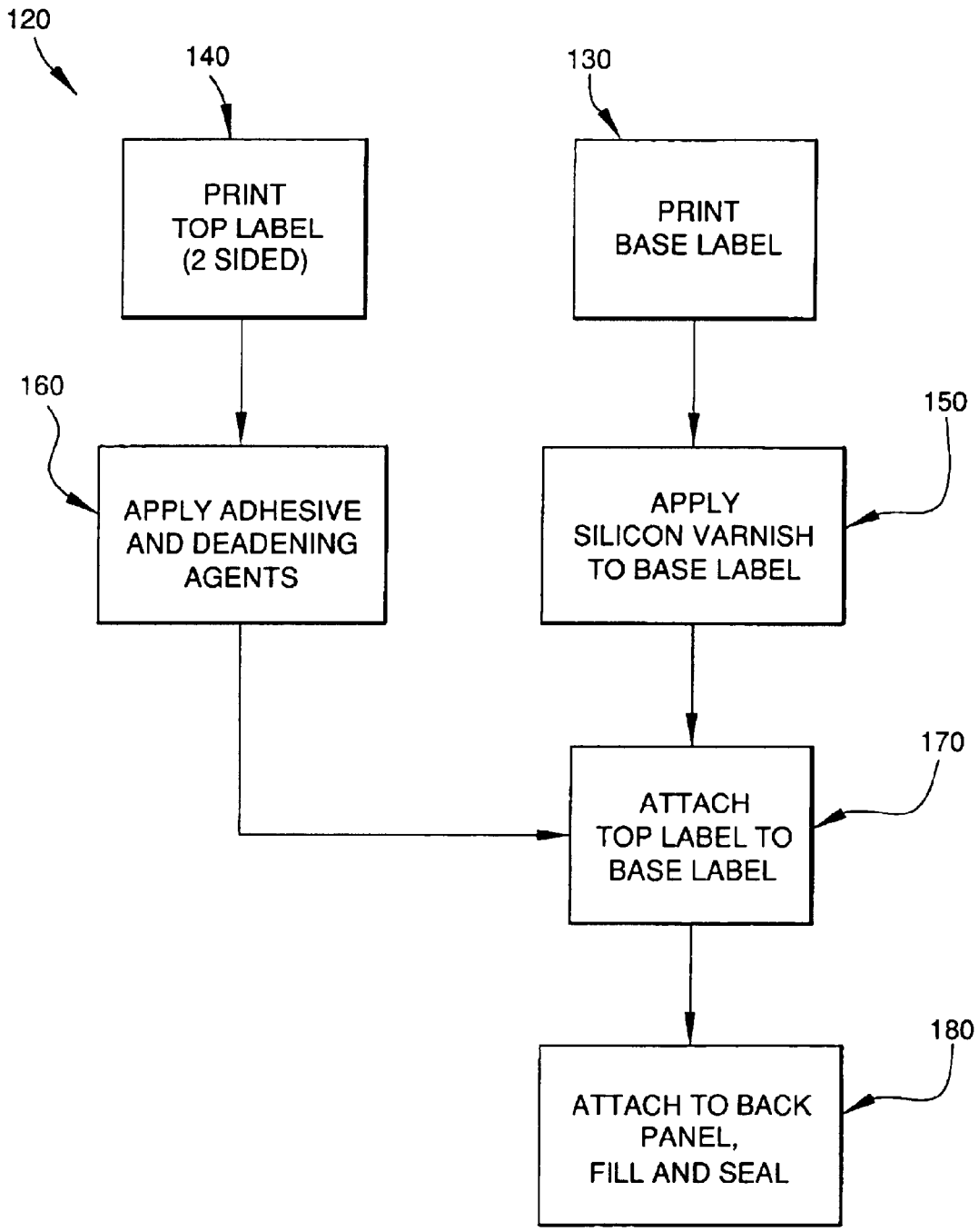
FIG. 2 illustrates a method for making a packaging pouch according to an aspect of the present invention.

It is to be understood that the figures and descriptions of the present invention have been simplified to illustrate elements that are relevant for a clear understanding of the present invention, while eliminating, for purposes of clarity, many other elements found in packaging. Those of ordinary skill in the art will recognize that other elements are desirable and/or required in order to implement the present invention. However, because such elements are well known in the art, and because they do not facilitate a better understanding of the present invention, a discussion of such elements is not provided herein. The disclosure herein is directed to all such variations and modifications to such systems and methods known to those skilled in the art.

According to an aspect of the present invention, a substantially planar packaging device including printed indicia and defining a closed cavity being suitable for containing at least one product is disclosed. According to an aspect of the invention this packaging device may include a first sheet forming the closed cavity, and a second sheet at least partially detachably coupled to the first sheet to allow the second sheet to be at least partially detached from the first sheet to view at least a portion of the indicia and reattached to the first sheet.

Referring now to FIG. 1A, there is shown a base label 10 according to a first form of the present invention. According to an aspect of the present invention, the base label 10 may take the form of a planar member and may be formed of any suitable material for forming a pouch. The base label 10 includes first and second oppositely-disposed surfaces 20, 30 (only the surface 20 is shown in FIG. 1A). According to this first form of the present invention, the surface 30 is secured to another planar member, or sheet, to form a pouch, cavity or pocket suitable for holding goods—such as pills, tablets, capsules or caplets, for example. According to an aspect of the present invention, the surface 20 includes a first portion 40 upon which a silicone varnish or other adhesive resistant material may be applied, and a second portion 50. As is illustrated in the particular embodiment of FIG. 1A, the portion 50 may surround the portion 40, although other configurations are of course possible. According to an aspect of the present invention, a peripheral part of the portion 50 is preferably used to seal the base label 10 to the other planar member, or sheet, to form the cavity and finished pouch.

Referring now also to FIG. 1B, there is shown a top label 60 suitable for use with the base label 10 of FIG. 1A. The top label 60 is preferably a flexible planar member, and may be formed of any suitable material, for example synthetic paper. The top label 60 also includes first and second oppositely disposed surfaces 70, 80 (only surface 80 is shown in FIG. 1B). The surface 80 may include an adhesive portion 90 for attaching the surface 80 of the top label 60 to the surface 20 of the base label 10. The surface 80 preferably also includes portions 100 and 110, which may have the adhesive properties or characteristics thereof partially deadened and preferably substantially completely deadened, respectively. Between the portions 90 and 100, 110 (preferably on three sides there-between) is a score 95. Alternatively, top label 60 may be sliced, slit or cut there at, for example.

Referring now to FIG. 1C, there is shown a panel suitable for use as part of a packaging pouch according to the first form of the present invention. Referring now also to FIGS. 1A and 1B, when the top label 60 is secured to the base label 10, using the adhesive portion 90, such that the portion 100 of the top label 60 is aligned with the portion 40 of the base label 10: the portion 110 may remain relatively unsecured to the base label 10, while the combination of the portions 100 and 40 make the portion 100 selectively securable, unsecurable and re-securable to the base panel 10. That is, the combination of the partial deadener, silicone varnish and slit 95 allow the portion 100 to be coupled to the portion 40 such that it may be unsecured and re-secured using hand pressure, without a need to reapply any adhesive. Further, the portion 110 may be used as a handle, for unsecuring or uncoupling and resecuring or re-coupling the portion 100 to the base label 10.

According to one aspect of the present invention, the portion 100 has an effective deadening of the adhesive property thereof of about 50%, while the adhesive property of the portion 110 preferably is approximately completely deadened.

According to another aspect of the present invention, the base label 10 and/or top label 60 include printing on areas thereof. According to yet another aspect of the present invention, the base label 10 includes printing in an area substantially identical to the portion 40. According to yet a further aspect of the present invention, the top label 60 includes printing on both surfaces 70 and 80. According to yet another aspect of the present invention, the top label includes printing on one or more of the following areas: on surface 70 in an area substantially corresponding to portion 100, and on surface 80 in an area substantially corresponding to portion 100.

According to another aspect of the present invention, a peripheral part of the portion 90 may be left relatively unaltered (e.g. not include substantial printing), as it corresponds to the portion of the base label 10 which may be used to seal with the other planar member to form a finished pouch, and hence may be at least partially distorted in the finished pouch.

According to an aspect of the present invention, a method for making a packaging device including printed indicia and including a pouch suitable for containing a product is disclosed. According to an aspect of the present invention, this method includes at least partially detachably coupling a first sheet to a second sheet, to allow the second sheet to be at least partially detached from the first sheet to view at least a portion of the indicia and reattached to the first sheet, the first sheet may be coupled to a second panel, or folded to form a second panel, wherein the first panel and the second panel form the pouch.

Referring now to FIG. 2, there is shown a method 120 for making a packaging pouch according to an aspect of the present invention. According to the method 120, the process begins by printing 130, 140 both the base label 10 and top label 60. This printing may be accomplished using suitable printing techniques. A silicon varnish may then be applied 150 to the base label 10. The adhesive and deadening agents are applied 160 to the top label 60. The adhesive and deadening agent may take any suitable form. The top and base labels 60, 10 may then be attached 170 for example along surfaces 50 and 70 to form a front panel of the finished pouch. The front panel may then be attached to a back panel (not shown) to form a pouch which may be filled, and sealed 180. Alternatively, the base label may be folded to form the pouch.

Referring now to FIGS. 3A, 3B and 3C, there are shown top 60 and base 10 labels and a panel for a packaging pouch according to a second form of the present invention. Referring now to FIG. 3A in particular, again there is shown a base label 10 including first and second oppositely disposed surfaces 20, 30 (again, surface 30 is not shown in FIG. 3A). Analogously to the first form of the invention, the surface 20 includes a first portion 40 upon which a silicone varnish is applied, and a second portion 50.

Referring now also to FIG. 3B, there is shown a plan-view of a top label 60 suitable for use with the base label 10 of FIG. 3A. The top label 60 again includes first and second oppositely disposed surfaces 70, 80 (only surface 80 is shown in FIG. 3B). The surface 80 includes an adhesive portion 90 for attaching the surface 80 of the top label 60 to the portion 50 of the base label 10. The surface 80 preferably also includes portions 100 and 110, which again have the adhesive properties thereof partially deadened and preferably substantially completely deadened, respectively.

Referring now also to FIG. 3C, there is shown a panel for a packaging pouch according to the second form of the present invention. Referring now also to FIGS. 3A and 3B, when the portion 90 of the top label 60 is secured to the portion 50 of the base label 10 such that the portion 100 of the top label 60 is aligned with the portion 40 of the base label 10: the portion 110 remains relatively unsecured to the base label 10, while the combination of the portions 100 and 40 make the portion 100 selectively securable, unsecurable and re-securable to the base panel 10 using the portion 110 as a handle, for example. That is, again the combination of the partial deadener and silicone varnish allow the portion 100 to be secured to the portion 40 such that it can be unsecured and re-secured using hand pressure, without a need to reapply any adhesive.

Figure 4B:
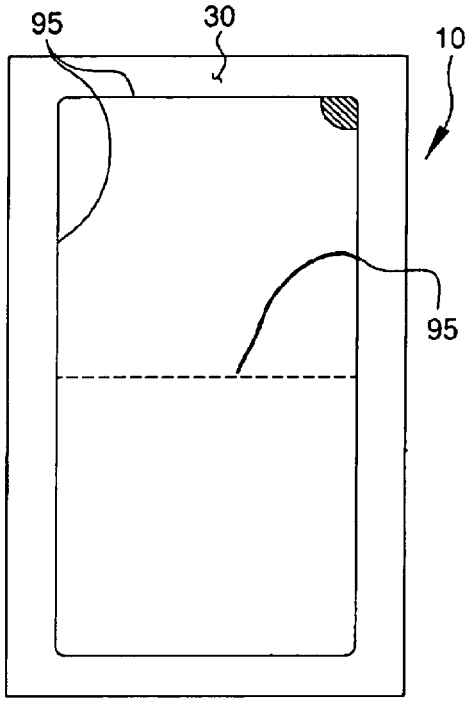
FIG. 4B illustrates a plan view of another surface of the base label of FIG. 4A.
Figure 4A:
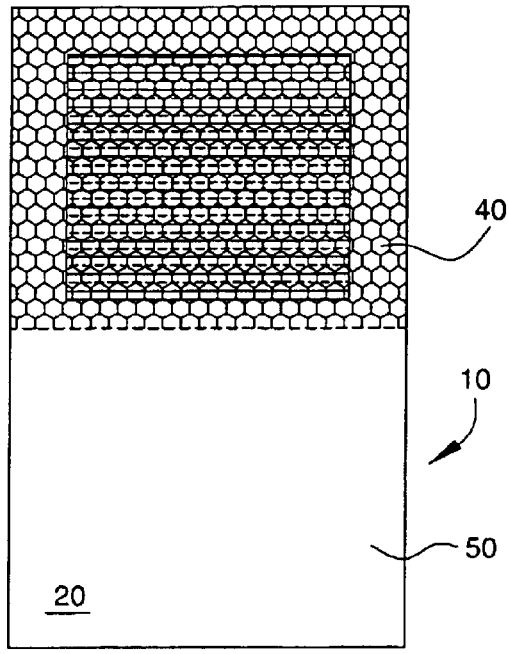
FIG. 4A illustrates a plan view of a surface of a base label for a packaging pouch according to a third form of the present invention.

Referring now to FIGS. 4A–4D there are shown a base label 10 and top label 60 suitable for forming a packaging pouch according to a third form of the present invention. Referring more particularly now to FIG. 4A, there is shown a first surface 20 of the base label 10. The surface 20 again includes a portion 40 having a silicon varnish applied thereto and a portion 50. Referring now also to FIG. 4B, there is shown a second surface 30 of the base label 10. Again, the surface 30 is oppositely disposed from the surface 20. According to another aspect of the present invention, the base label 10 includes the score or cut 95 which forms two foldable and re-seal-able pages.

Figure 4D:
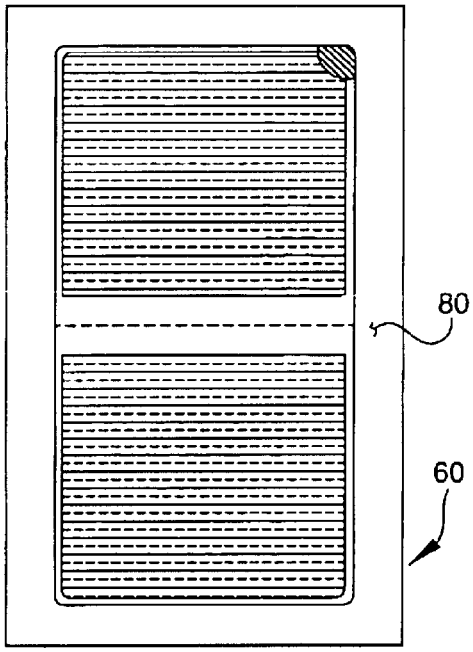
FIG. 4D illustrates another surface of the top label of FIG. 4C.
Figure 4C:
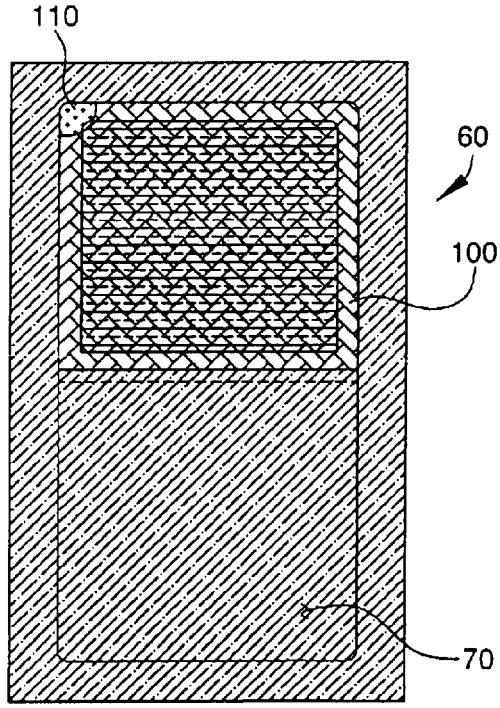
FIG. 4C illustrates a plan view of a surface of a top label suitable for use with the base label of FIGS. 4A and 4B according to an aspect of the present invention.

Referring now also to FIG. 4C, there is shown a first surface 70 of a top label 60 suitable for use with the base label 10 of FIGS. 4A and 4B. According to an aspect of the present invention the surface 70 has an adhesive deposited thereon. The surface 70 also includes a portion 100 and portion 110. According to another aspect of the present invention, the portion 100 has its adhesive characteristics partially deadened, while the portion 110 has its adhesive characteristics substantially completely deadened. Referring now also to FIG. 4D, there is shown a surface 80 of the top label 60 of FIG. 4C. Again, the surfaces 70, 80 are oppositely disposed from one another.

Referring now to FIGS. 4A–4D, the surface 20 of the base label 10 is adhesively coupled to the surface 70 of the top label 60. In this way, when folded transversely in half, the combination of base and top labels 10, 60 form a sealable pouch having the surface 30 of the base label 10 as an interior wall of an interior cavity and surface 80 of the top label 60 forming an outside surface thereof. According to another aspect of the present invention, the base label 10 and/or top label 60 include printing in areas thereof. According to another aspect of the present invention, the base label 10 includes printing on the surface 20 in an area substantially bounded by portion 40, and/or the top label 60 includes printing on the surface 70 in an area substantially bounded by the portion 100, and/or on the surface 80 in one or more areas corresponding to the relatively flat areas of the pouch formed when the combination of labels 10 and 60 are folded transversely.

Again, the base label 10 and top label 60 may include a peripheral buffer around the printing and portion 100 so as to accommodate room for sealing the finished pouch once the combination of the base and top labels 10, 60 are transversely folded to form a cavity.

Referring now to FIGS. 5A–5D, there is shown a fourth form of the present invention. Referring first to FIG. 5A, there may be shown a first surface 20 of a base label 10. The surface 20 again includes a portion 40 having a silicon varnish applied thereto and a portion 50. Referring now also to FIG. 5B, there is shown a second surface 30 of the base panel 10. Again, the surface 30 is oppositely disposed from the surface 20.

Referring now also to FIG. 5C, there is shown a first surface 70 of a top label 60 suitable for use with the base label 10 of FIGS. 5A and 5B. According to an aspect of the present invention the surface 70 has an adhesive deposited thereon. The surface 70 also includes a portion 100 and portion 110. Again, according to an aspect of the present invention, the portion 100 has its adhesive characteristics partially deadened, while the portion 110 has its adhesive characteristic substantially completely deadened. Referring now also to FIG. 5D, there is shown a surface 80 of the top label 60 of FIG. 5C. Again, the surfaces 70, 80 are oppositely disposed from one another.

Referring now to FIGS. 5A–5D, as set forth with regard to FIGS. 4A–4D, the surface 20 of the base label 10 is adhesively coupled to the surface 70 of the top label 60. In this way, when folded transversely in half, the combination of base and top labels 10, 60 form a sealable pouch having the surface 30 of the base label as an interior wall of an internal cavity and surface 80 of the top label 60 forming an outside surface thereof. According to another aspect of the present invention, the base label 10 and/or top label 60 again include printing in areas thereof. According to another aspect of the present invention, the base label 10 includes printing on the surface 20 in an area substantially bounded by portion 40. According to another aspect of the present invention, the top label 60 includes printing on the surface 70 in an area substantially bounded by the portion 100. According to another aspect of the present invention, the top label 60 includes printing on the surface 80 in one or more areas corresponding to the flat areas of the pouch formed when the combination of labels 10 and 60 are folded transversely.

Different from the form of the present invention pictured in and discussed with regard to FIGS. 4A–4D, in the form of the present invention shown in FIGS. 5A–5D the top label 60 may be smaller in overall dimensions than the base label 10. This facilitates providing a peripheral buffer around the top label 60 so as to accommodate room for sealing the finished pouch once the combination of the base and top labels 10, 60 are transversely folded.

Any and all dimensions illustrated in the non-limiting Figures are for illustrative purposes only, and are not intended to be limiting in any manner. Although the invention has been described and pictured in a preferred form with a certain degree of particularity, it is understood that the present disclosure of the preferred for has been made by way of example, and that numerous changes in the details of construction and combination and arrangement of parts may be made without departing from the spirit and scope of the invention.

What is claimed is:

1. A packaging pouch comprising:

a first planar member at least partially defining a closed cavity and including a silicon varnish on at least a portion thereof;

a second planar member adhesively coupled to said first planar member;

wherein, at least a portion of said second planar member is adhesively coupled to said silicon varnished at least portion of said first planar member such that said coupled second planar member is suitable for being decoupled and recoupled thereto;

an adhesive on at least a portion of said second planar member and provided on the same surface as the adhesively coupled portion; and a deadening agent on at least a portion of said adhesive.

2. A packaging pouch comprising:

a first planar member at least partially defining a closed cavity and including a silicon varnish on at least a portion thereof;

a second planar member adhesively coupled to said first planar member;

wherein, at least a portion of said second planar member is adhesively coupled to said silicon varnished at least portion of said first planar member such that said coupled second planar member is suitable for being decoupled and recoupled thereto;

an adhesive on at least a portion of said second planar member and provided on the same surface as the adhesively coupled portion; and wherein a portion of said adhesive on said second planar member is at least partially deadened.

3. The pouch of claim 2, wherein at least one other portion of said adhesive is substantially completely deadened.

4. A packaging pouch comprising:

a first planar member at least partially defining a closed cavity and including a silicon varnish on at least a portion thereof;

a second planar member adhesively coupled to said first planar member;

wherein, at least a portion of said second planar member is adhesively coupled to said silicon varnished at least portion of said first planar member such that said coupled second planar member is suitable for being decoupled and recoupled thereto;

printing on at least one of said first and second planar members and provided on the same surface as the adhesively coupled portion; and at least a third planar member coupled to said second planar member on it's surface opposite to that of the surface coupled to the first planar member and so as to form a cavity and printing on at least one of said first, second and third planar members, wherein at least a portion of said printing is indicative of a contents of said cavity.

* * * * *